US005855213A

United States Patent [19]

Hildebrandt

[11] Patent Number: 5,855,213

[45] Date of Patent: Jan. 5, 1999

[54] PERMANENT WAVE CLIP

[75] Inventor: Bodo Hildebrandt, Riedstadt, Germany

[73] Assignee: Wella AG, Darmstadt, Germany

[21] Appl. No.: 22,329

[22] Filed: Feb. 11, 1998

[30] Foreign Application Priority Data

Feb. 28, 1997 [DE] Germany ..... 197 08 100.2

[51] Int. Cl.[6] ..... A43B 23/24; A41D 27/20

[52] U.S. Cl. ..... 132/245; 132/250; 132/248; 132/249; 132/251

[58] Field of Search ..... 132/207, 210, 132/248, 249, 250, 251, 252, 257, 258, 261, 245

[56] References Cited

U.S. PATENT DOCUMENTS 4,027,684 6/1977 Mueller ..... 132/251
4,216,787 8/1980 Moea ..... 132/251
5,482,060 1/1996 Barradas ..... 132/226

FOREIGN PATENT DOCUMENTS 3709273 9/1988 Germany ..... 132/207
43 00 166 A1 7/1994 Germany ..... 132/207

*Primary Examiner*—Gene Mancene
*Assistant Examiner*—Trang Doan
*Attorney, Agent, or Firm*—Michael J. Striker

[57] ABSTRACT

The permanent wave clip (1) has three curlers (2,3,4) which can be arranged parallel to each other including a releasable and exchangeable hair tip curler (6) rotatable about its axis which is clipped in a curler holder (7). A curler (2), which is a hair root curler (9), has a smaller diameter than the hair tip curler (6). The central hair curler (3) can be pivoted out of and into a parallel relationship with the other curlers by means of a pivot (17) in a preferred embodiment. The permanent wave clip (1) is easily operated and provides an outstanding hair root curl.

5 Claims, 2 Drawing Sheets

PERMANENT WAVE CLIP

BACKGROUND OF THE INVENTION

The present invention concerns a permanent wave clip with three curlers, which can be arranged with their long axes substantially parallel and with an outer hair tip curler furthest from the hair roots, which is exchangeable and rotatable about its long axis and with a connection device for connection of the curlers.

This type of permanent wave clip is described in German Published Patent Application DE-OS 43 00 166. A hair strand is first wound in a curved shape around a first curler closest to the hair roots (hair root curler), then is curled in the opposite direction around a central curler and finally wound around a third curler (the hair tip curler) in the same direction as in the case of the first hair root curler. The three curlers are releasably and/or elastically connected with each other. The hair tip curler is rotatable.

The known permanent wave clip of this type has the disadvantage that it is comparatively difficult to handle or manipulate and the hair tip curler can be placed in a position predetermined by the connection device between the curlers with a comparatively great effort. Furthermore the permanent wave clip of the prior art is hardly suitable to obtain a good hair root curl.

SUMMARY OF THE INVENTION

It is an object of the present invention to provide a permanent wave clip of the above-described type that provides improved hair root curling and which has improved handling.

According to the invention, the permanent wave curler comprises an outer hair tip curler, a curler holder in which the outer hair tip curler is releasably and exchangeably clipped and is rotatable, a hair root curler having a diameter smaller than that of the hair tip curler, a central hair curler arranged between the hair tip curler and the hair root curler and a connection device connecting all curlers so that all curlers can be arranged with their long axes substantially parallel to each other and so that a hair strand can be wound around the curlers with the hair root curler closest to hair roots of the hair strand and with the outer hair tip curler furthest from the hair roots.

The permanent wave clip has the advantage that the handling of the clip in operation is improved and a better curl is obtained in the hair strand in the vicinity of the hair roots.

Because the hair tip curler can be clipped in the curler holder, a hair strand can be wound on the hair tip curler in a simple way by the hair tips before it is clipped in the curler holder. The clipping and release of the hair tip curler in the curler holder and/or from the curler holder can be performed reliably and rapidly. An improved hair curl is obtained in the hair strand in the vicinity of the hair roots because the diameter of the hair root curler is comparatively small and because a comparatively large bending of the hair strand occurs directly at the scalp.

Various preferred embodiments of the permanent wave clip according to the invention are possible.

If the curler holder is a clip element extending around the hair tip curler (when the hair tip curler is clipped in it) somewhat more than a half shell shaped element, it is possible to clip hair strands on the hair tip curler with hair tip curlers of different lengths. Because of the elasticity of the clip it can receive hair tip curlers of different thickness.

A hair strand can be attached to the hair tip curler by means of an elastic element in order to achieve sufficient hair stand tension. The elastic element can be stretched between two axial pins arranged on the end surfaces of the hair tip curler.

The handling of the permanent wave clip is clearly improved when the central curler is pivotable by means of a pivot provided in the connection device and can be fixed in a position in which it is substantially parallel to the other curlers by means of a holding device. After winding a hair strand on the hair tip curler the hair strand is placed on the hair root curlers and then the central curler is swung from its open position into its parallel position, and fixed in its parallel position, e.g. by means of a releasable locking device. The hair tip curler can be clipped in the curler holder prior to or after the closing of the central curler. The pivot connection of the central curler in the permanent wave clip has the advantage that the central curler is easily accessible continuously in the permanent wave clip.

Furthermore the permanent wave clip is advantageously provided in two separate parts, namely the hair tip curler and a remaining part, and these separate parts are manipulated in operation. The pivot can then be a film articulated or hinge pivot. An economical manufacture is thus provided. Furthermore cost reductions are provided when the entire, two-part permanent wave clip is made of a plastic material.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENT

Figure 1:
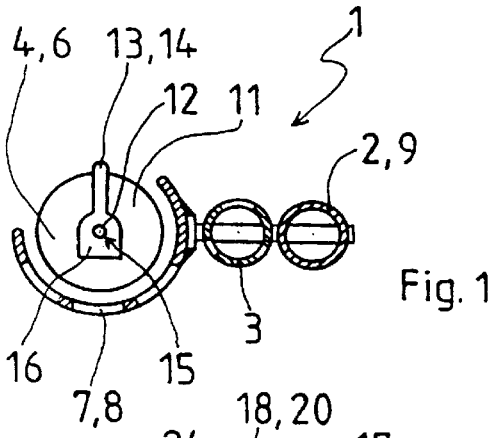
FIG. 1 is a partially vertical cross-sectional, partially side view of a permanent wave clip with three curlers, in which the hair tip curler is clamped or held in a curler holder and the hair root curler has a smaller diameter than the hair tip curler.
Figure 4:
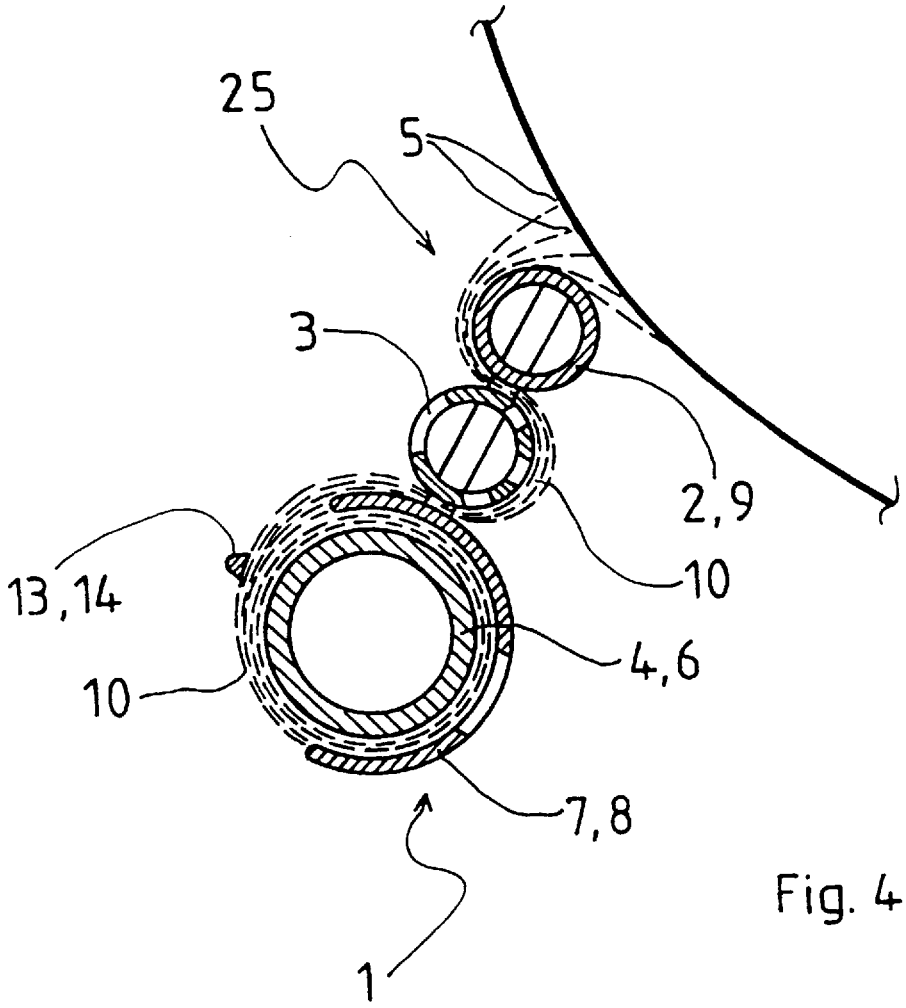
FIG. 4 is a vertical cross-sectional view of the device shown in FIG. 1, but with a hair strand wound on it.

A permanent wave clip 1 is shown in FIGS. 1 and 4 and comprises three curlers 2,3 and 4.

The outer hair tip curler 6 furthest from the hair roots 5 is clamped in a curler holder 7 and is rotatable in it and removable from it. The curler holder 7 is a clip element 8 engaging around the hair tip curler extending around it somewhat more than a half-shell shaped member would. The curler closest to the hair roots 5, the hair root curler 9, has a smaller diameter than the hair tip curler 6, so that a particularly good root curl is obtained in a hair strand 10 wound around it. An axially arranged pin 12 is provided on each end face 11 of the hair tip curler 6. An elastic element 13 in the form of a rubber band 14 is stretched between the pins 12. Each pin 12 engages in a hole 15 in a handle end portion 16 of the elastic element 13. The rubber band 14 holds the hair strand 10 on the hair tip curler 6.

Figure 2:
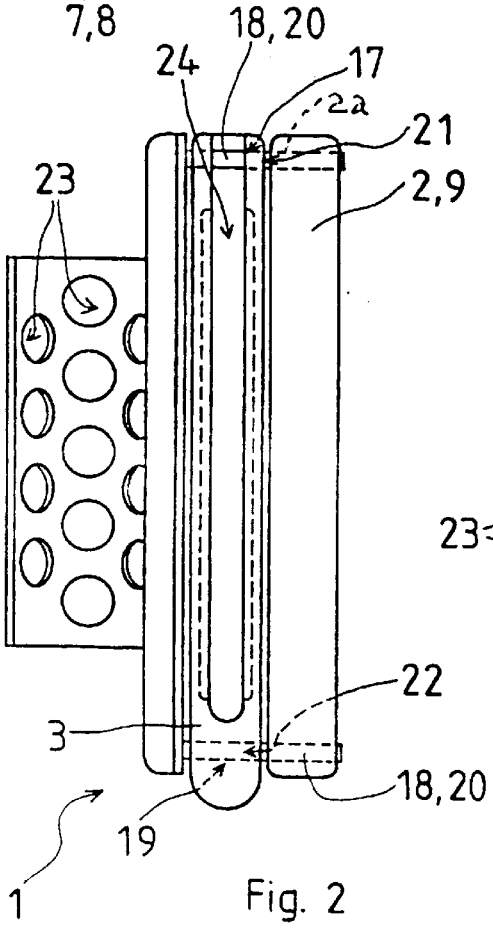
FIG. 2 is a top view of the device shown in FIG. 1, however without the hair tip curler.
Figure 3:
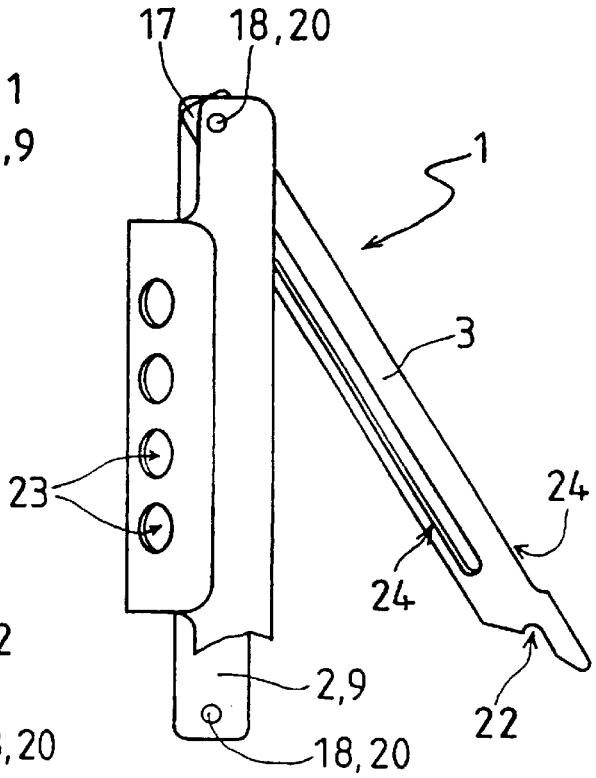
FIG. 3 is a partially cutaway side view of the device shown in FIG. 2 rotated or turned about 90°.

The center curler 3 of the permanent wave clip 1 is pivotable to and from its position substantially parallel with the other curlers by means of a pivot 17 in a connection device 18 which connects the curlers (FIG. 2) and is securable (FIG. 2) again in its parallel position by means of a holding device 19 (FIG. 2). The pivot 17 is formed by a rod 2*a* in the connection device 18, which extends through a hole 21 provided in one end portion of the central curler 3. A latching member 22 engagable with and lockable on an another rod 20 in the connection device 18 operates as the holding device 19.

Holes 23 and slots 24 are provided in the permanent wave clip 1 in order to obtain the permanent wave clip with a greater flexiblity or elasticity.

A hair strand 10 is first wound on the hair tip curler 6 removed from the remainder of the permanent wave clip 1 and is clamped with the rubber band 14 on the hair tip curler 6. Then the hair root curler 9 with the central curler swung out is engaged with the hair strand on the hair roots 25, and the hair tip curler 6 is then clamped in the curler holder 7. Subsequently the central curler 3 is pivoted back into its parallel position and locked in place with the holding device 19.

The disclosure of German Patent Application 197 08 100.2 of Feb. 28, 1997 is hereby explicitly incorporated by reference. This German Patent Application discloses the same invention as described herein and claimed in the claims appended hereinbelow and is the basis for a claim of priority for the instant invention under 35 U.S.C. 119.

While the invention has been illustrated and described as embodied in a permanent wave clip, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

I claim:

1. A permanent wave clip comprising an outer hair tip curler (6), a curler holder (7) in which the outer hair tip curler (6) is releasably and exchangeably clipped and is rotatable, a hair root curler (9) having a diameter smaller than that of the hair tip curler (6), a central hair curler (3) arranged between the hair tip curler (6) and the hair root curler (9), and a connection device (18) connecting all of the curlers so that longitudinal axes of all of said curlers can be arranged substantially parallel to each other and so that a hair strand can be wound around said curlers with the hair root curler closest to hair roots of the hair strand and with the outer hair tip curler furthest from the hair roots;

wherein an axially oriented pin (12) is arranged on each of two end faces (11) of the hair tip curler (6) and an elastic element (13) is stretched between the pins (12).

2. A permanent wave clip comprising an outer hair tip curler (6), a curler holder (7) in which the outer hair tip curler (6) is releasably and exchangeably clipped and is rotatable, a hair root curler (9) having a diameter smaller than that of the hair tip curler (6), a central hair curler (3) arranged between the hair tip curler (6) and the hair root curler (9), and a connection device (18) connecting all of the curlers so that longitudinal axes of all of said curlers can be arranged substantially parallel to each other and so that a hair strand can be wound around said curlers with the hair root curler closest to hair roots of the hair strand and with the outer hair tip curler furthest from the hair roots;

wherein a pivot (17) is provided in the connection device (18) by means of which the central hair curler (3) is swung out from and into a position substantially parallel with the hair tip curler and the hair root curler.

3. The permanent wave clip as defined in claim 2, wherein the curler holder (7) is a clip element (8) engagable around the hair tip curler (6) and extends around the hair tip curler somewhat more than a half-shell shaped element.

4. The permanent wave clip as defined in claim 2, wherein said pivot is a film hinged pivot.

5. The permanent wave clip as defined in claim 4, consisting of one portion and a residual portion separable from the one portion, said one portion consisting of the hair tip curler and said residual portion including remaining parts thereof and not the hair tip curler, said residual portion being made of a plastic material.

* * * * *